US006698331B1

(12) United States Patent
Yu et al.

(10) Patent No.: US 6,698,331 B1
(45) Date of Patent: Mar. 2, 2004

(54) USE OF METAL FOAMS IN ARMOR SYSTEMS

(75) Inventors: Chin-Jye Yu, Newark, DE (US); Terry Dennis Claar, Newark, DE (US); Harald H. Eifert, Hockessin, DE (US)

(73) Assignee: Fraunhofer USA, Inc., Plymouth, MI (US)

( * ) Notice: Subject to any disclaimer, the term of this patent is extended or adjusted under 35 U.S.C. 154(b) by 0 days.

(21) Appl. No.: 09/719,666

(22) PCT Filed: Mar. 10, 2000

(86) PCT No.: PCT/US00/06220

§ 371 (c)(1),
(2), (4) Date: Feb. 26, 2001

(87) PCT Pub. No.: WO00/55567

PCT Pub. Date: Sep. 21, 2000

Related U.S. Application Data

(60) Provisional application No. 60/123,569, filed on Mar. 10, 1999.

(51) Int. Cl.[7] ..... F14H 5/04

(52) U.S. Cl. ..... 89/36.02; 89/36.04; 89/36.08; 428/613

(58) Field of Search ..... 89/36.02, 36.08, 89/36.04; 428/546, 548, 613, 615; 109/49.5, 85; 419/2, 5

(56) References Cited

U.S. PATENT DOCUMENTS

| | | | | | |
|---|---|---|---|---|---|
| 3,711,363 | A | * | 1/1973 | Jarema et al. | 428/309.9 |
| 3,834,881 | A | * | 9/1974 | Niebylski | 267/130 |
| 4,099,961 | A | * | 7/1978 | Patten | 109/85 |
| 4,131,053 | A | * | 12/1978 | Ferguson | 109/82 |
| 4,364,300 | A | * | 12/1982 | Pagano et al. | 109/85 |
| 4,973,358 | A | | 11/1990 | Jin et al. | 75/415 |
| 5,112,697 | A | * | 5/1992 | Jin et al. | 428/613 |
| 5,151,246 | A | | 9/1992 | Baumeister et al. | 419/2 |
| 5,181,549 | A | | 1/1993 | Shapovalov | 164/79 |
| 5,290,637 | A | * | 3/1994 | Sliney | 204/192.15 |
| 5,482,533 | A | * | 1/1996 | Masuda et al. | 164/79 |
| 5,516,592 | A | * | 5/1996 | Yang et al. | 428/217 |
| 6,253,655 | B1 | * | 7/2001 | Lyons et al. | 89/36.02 |
| 6,286,896 | B1 | * | 9/2001 | Eipper et al. | 296/189 |

OTHER PUBLICATIONS

Okumura "Deformation Behavior of Aluminum Cellular Materials under High Temperature Condition", Mar. 2001, located a www.mc.mat.shibaura–it.ac.jp/~master/online/on-line2000/299107/299107.html.*

* cited by examiner

*Primary Examiner*—Charles T. Jordan
*Assistant Examiner*—John W Zerr
(74) *Attorney, Agent, or Firm*—Raphael A. Monsanto; Benita J. Rohm

(57) ABSTRACT

In a multi-layer armor system (10), useful for military vehicles, a metallic foam is provided as the shock energy-absorbing element. In a typical arrangement, the metallic foam shock-absorbing element (12) is sandwiched between a high strength strike plate (11) and a backing plate (13). Typically, the backing plate is a highly deforming metal, such as titanium, aluminum, or steel. However, the backing plate may comprise one or more layers of metal, ceramic or polymer-based composites. The high strength strike plate may be ceramic or metal. The shock-absorbing element is preferably a closed-cell metal foam with a high porosity that is effective in containing rearward deformation of the strike plate from a projectile strike. In a preferred embodiment, the shock-absorbing element is an aluminum foam with a porosity of 80 percent by volume.

8 Claims, 2 Drawing Sheets

1 CM

2 CM

USE OF METAL FOAMS IN ARMOR SYSTEMS

This application claims the benefit of provisional application Ser. No. 60/123,569, filed Mar. 10, 1999.

BACKGROUND OF THE INVENTION

1. Field of the Invention

This invention relates generally to armor systems for structural protection against ballistic impact or explosive blast, and more particularly to the use of a metallic foam as the shock energy-absorbing element in a multi-layer armor system.

2. Description of the Related Art

With increasing terroristic violence and military action, there is a need for improved structural protection against ballistic impact from projectiles or blast protection from explosives. Such structural protection can be built into the infrastructure of a building to reinforce the building, or certain rooms within a building, against attack. Structural protection is also useful in vehicles, illustratively military vehicles, such as tanks, or civilian VIP vehicles. Presently, a multi-layer armor system is employed in known vehicular applications.

A typical configuration for the armor system in medium weight military vehicles, for example, consists of a high strength strike face (either a metal or a ceramic plate), bonded to a ceramic tile, which is subsequently bonded to a metallic backing plate. In this configuration, the ceramic tile breaks-up or deforms an incoming projectile, and the metallic backing "catches" the extant penetrator and ceramic fragments. The high strength strike plate aids the ceramic tile by providing front face confinement, and may, in some cases, protect the ceramic tile from field damage.

Upon projectile impact at typical ordnance velocities, a stress wave is generated and propagates through the ceramic tile. Reflections from boundaries and subsequent stress wave interactions result in tensile stress states and attendant microcracking. Microcracking due to these impact-induced stress waves weakens the ceramic tile, allowing a projectile to penetrate more easily. In armor system designs utilizing a metal strike plate over ceramic tile, stress waves from a projectile impact on the metal strike plate can run ahead into the ceramic, and failure may initiate prior to contact of the projectile with the ceramic tile. There is, therefore, a need for an armor system having an improved shock-absorbing element, and more particularly, a shock-absorbing element that gives more control of behind-the-target effects, such as backface deformation and spalling.

Metallic foams with a high fraction of porosity are a new class of materials which have attributes that lend themselves to various engineering applications, including sound and heat isolation, lightweight construction, and energy absorption. The latter two applications, in particular, make use of the unique characteristics of a metallic cellular material, specifically the combination of its comparatively high specific strength and its characteristic non-linear deformation behavior. As will be described more completely hereinbelow, certain metal foams are effective in containing rearward deformation of a target under high-speed impact, and therefore are useful in controlling backface deformation and spalling. Moreover, metal foams are capable of mitigating impact-induced stress waves thereby delaying damage to ceramic layers in armor systems employing same.

It is, therefore, an object of the invention to provide an armor system incorporating metal foam as a shock energy-absorbing element to improve protection of equipment and personnel behind the target.

It is a further object of the invention to provide an armor system incorporating metal foam as a shock energy-absorbing element to control behind-the-target effects as a result of backface deformation caused by the high energy impact of a projectile.

SUMMARY OF THE INVENTION

The foregoing and other objects, features and advantages are achieved by this invention which provides a metallic foam as a shock-absorbing element in a multi-layer armor system. In preferred embodiments, the metallic foam has a closed-cell pore structure and a high fraction of porosity, preferably ranging from about 50–98 percent by volume.

Metallic foams useful in the practice of the present invention may be, but are not limited to, metal foams of aluminum, steel, lead, zinc, titanium, nickel and alloys or metal matrix composites thereof. Metal foams can be fabricated by various processes that are known for the manufacture of metal foams, including casting, powder metallurgy, metallic deposition, and sputter deposition. Exemplary processes for making metal foams are set forth in U.S. Pat. Nos. 5,151,246; 4,973,358; and 5,181,549, the text of which is incorporated herein by reference.

U.S. Pat. No. 5,151,246, for example, describes a powder metallurgy process for making foamable materials using metallic powders and small amounts of propellants. The process starts by mixing commercially available metal powder(s) with a small amount of foaming agent. After the foaming agent is uniformly distributed within the matrix material, the mixture is compacted to yield a dense, semi-finished product without any residual open porosity. Further shaping of the foamable material can be achieved through subsequent metalworking processes such as rolling, swaging or extrusion.

Following the metalworking steps, the foamable material is heated to temperatures near the melting point of the matrix metal(s). During heating, the foaming agent decomposes, and the released gas forces the densified material to expand into a highly porous structure. The density of the metal foams can be controlled by adjusting the content of the foaming agent and several other foaming parameters, such as temperature and heating rate. The density of aluminum foams, for example, typically ranges from about 0.5 to 1 $g/cm^3$.

Strength, and other properties of foamed metals can be tailored by adjusting the specific weight (or porosity), alloy composition, heat treatment history, and pore morphology as is known to those of skill in the art. In advantageous embodiments, the metallic foam will have high mechanical strength.

Metal foams are easily processed into any desired shape or configuration by conventional techniques, such as sawing drilling, milling, and the like. Moreover, metal foams can be joined by known techniques, such as adhesive bonding, soldering, and welding.

In certain preferred embodiments of the invention, the shock-absorbing element is closed-cell aluminum foam, and in a specific illustrative embodiment, the shock-absorbing element is closed-cell aluminum foam with a porosity of 80 percent by volume.

In device embodiments of the present invention, a multi-layered armor system, suitable for structural protection against ballistic impact or explosive blast, such as armor systems used in connection with military armored vehicles, includes one or more layers of a metal foam as a shock energy-absorbing element.

As used herein, the term "multi-layer armor system" means at least two plates of metal, metal foam, ceramic, plastic, and the like, known or developed, for defense or protection systems. In the present invention, the multi-layer armor system includes at least a strike plate, or buffer plate, bonded or otherwise held in communication with, a shock-absorbing element that is a layer of metallic foam.

As described hereinabove, the metallic foam preferably has a closed-cell pore structure and a high fraction of porosity. Illustratively, the metallic foam may be aluminum, steel, lead, zinc, titanium, nickel and alloys or metal matrix composites thereof, with porosity ranging from about 50–98 percent by volume. In a particularly preferred embodiment of the invention, the metallic foam is a closed-cell aluminum foam having a porosity of 80 percent by volume.

The term "strike plate" refers to a high strength metal or ceramic plate that has a front face surface that would receive the initial impact of a projectile or blast. The back surface of the strike plate is adjacent to a first surface of the shock-absorbing element that, in the present invention, is a sheet or layer of metallic foam. It is to be understood that the term "strike plate," as used herein, refers to any buffer plate of a high strength material that receives impact or impact-induced stress waves prior to a shock-absorbing element.

The strike plate may be a flat sheet of a high strength metal, ceramic or polymer-based composite, such as a fiber-reinforced polymer composite.

In a preferred embodiment, the multi-layer armor system of the present invention further includes a deformable backing plate bonded to, or otherwise held in communication with, a face surface of the metallic foam sheet or layer opposite, or distal, to the surface contiguous to the strike plate. The backing plate illustratively is a sheet of a deformable metal, such as titanium, aluminum, or steel.

In a specific illustrative embodiment of a multi-layer armor system in accordance with the invention, a shock-absorbing layer of metallic foam is sandwiched between a high strength strike plate and a deformable backing plate. Of course, the multi-layered armor system may comprise additional elements, in any sequence, and the embodiments presented herein are solely for the purposes of illustrating the principles of the invention.

BRIEF DESCRIPTION OF THE DRAWING

Comprehension of the invention is facilitated by reading the following detailed description, in conjunction with the annexed drawing, in which.

DETAILED DESCRIPTION OF THE INVENTION

Figure 1:
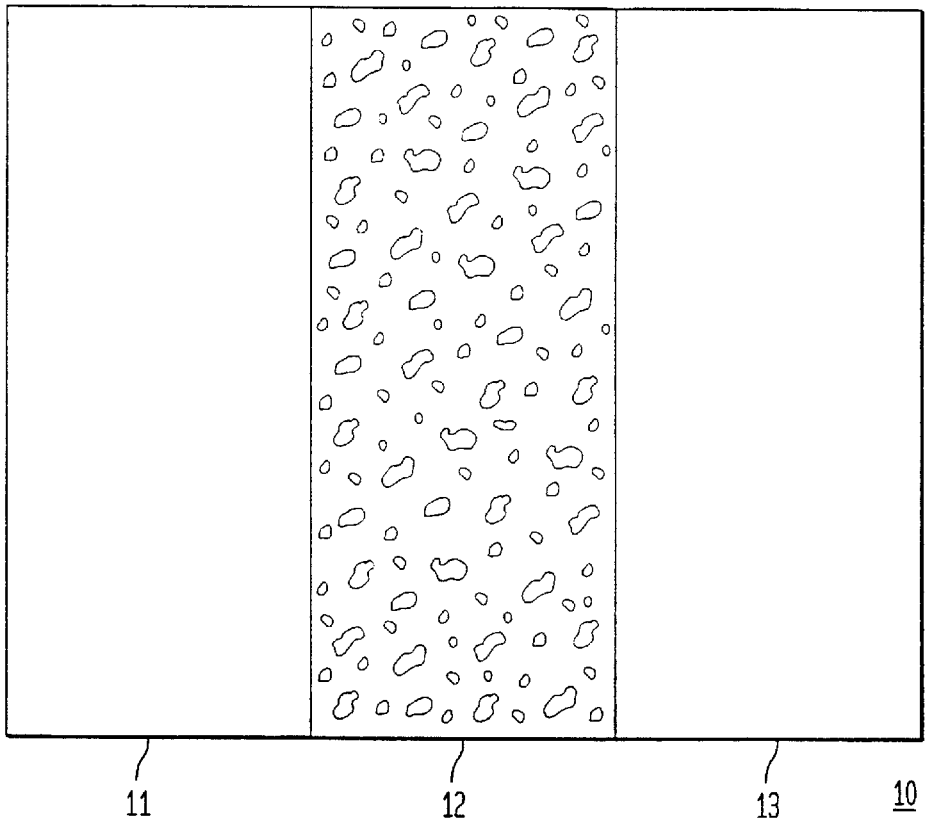
FIG. 1 is a schematic representation of an illustrative armor system incorporating metallic foam as a shock energy-absorbing element in accordance with the principles of the present invention.

FIG. 1 is an illustrative schematic representation of an improved armor system 10 of the type having a high strength strike plate 11, at least one shock energy-absorbing element 12, and a backing plate 13. In the embodiment of FIG. 1, a closed-cell metal foam is used as shock energy-absorbing element 12. High strength strike plate 11 may be ceramic or metal. Backing plate 13 is typically a highly deforming metal, such as titanium, aluminum, or steel. However, backing plate 13 may comprise one or more layers of metal and/or ceramic, as well as polymer-based composites. In armor system 10, the closed-cell metal foam is effective in containing rearward deformation of the strike plate 11 in a ballistic target structure. The metal foam has the ability to control backface deformation, without sacrificing ballistic efficiency behind targets with highly deforming back plates, via a mechanism that will be discussed more completely hereinbelow.

Figure 2:
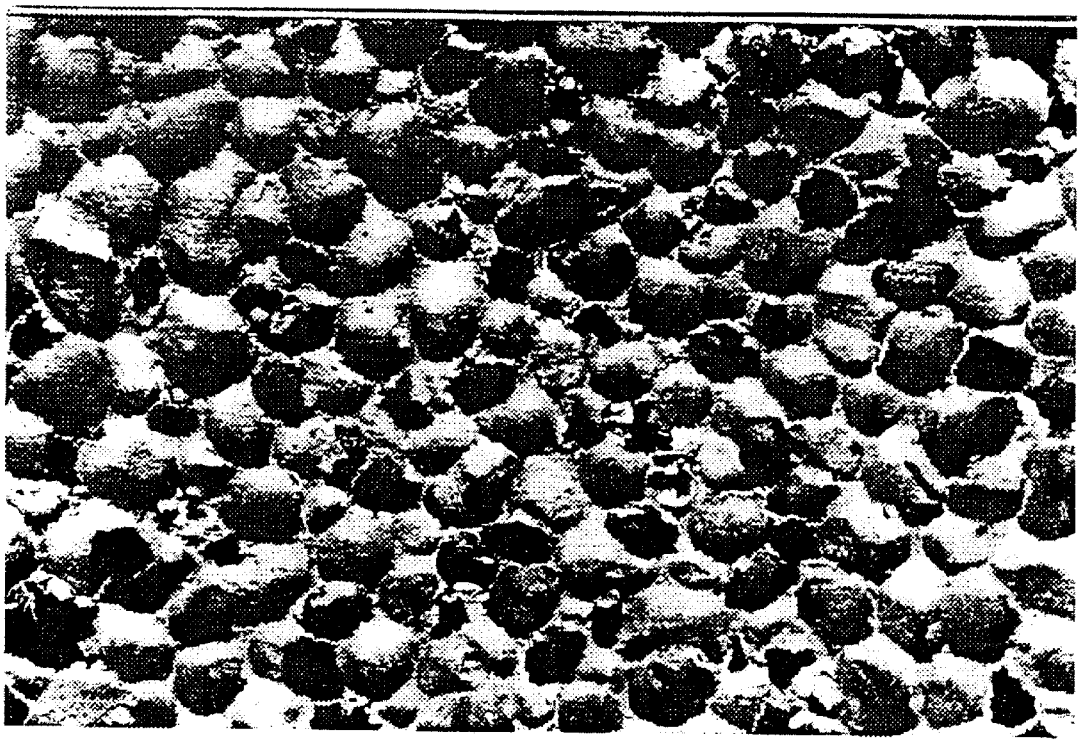
FIG. 2 is a photomicrograph of a high porosity, closed-cell aluminum foam showing the typical microstructure in cross-section.

The shock energy-absorbing element 12 preferably comprises a closed-cell metallic foam which, illustratively, may be aluminum, steel, lead, zinc, titanium, nickel, and alloys or metal matrix composites thereof. Preferred metal foams have a high fraction of porosity, typically ranging from about 50–98 percent by volume. In a specific preferred embodiment, shock energy-absorbing element 12 is a closed-cell aluminum foam having a porosity of 80 percent by volume. FIG. 2 shows the microstructure (i.e., the pore structure) of this particular aluminum foam material.

This type of pore structure provides a substantial increase in the stiffness/weight ratio (SWR) of the material with a low fractional density. Under deformation, this microstructure features localized cell collapse and rapid compaction energy dissipation, which leads to unique deformation behaviors and material properties including high SWR and energy absorption in the material.

Figure 3:
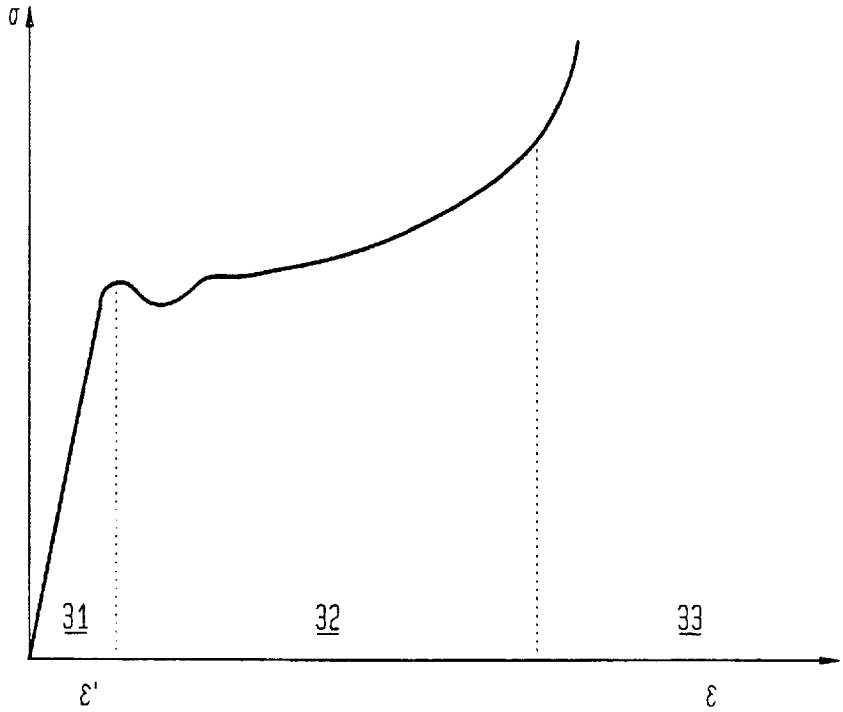
FIG. 3 is a graphical representation of the typical behavior of a metal foam, of the type shown in FIG. 2, under a uniaxial load.

During deformation, metal foams of the type shown in FIG. 2, exhibit the universal deformation behavior shown in FIG. 3 as they move from the quasi-elastic regime to the plastic regime. FIG. 3 is a graphical representation of the behavior of the metal foam of FIG. 2 under uniaxial load referred to as a "loading curve." The vertical axis of FIG. 3 represents stress and the horizontal axis represents strain. The loading curve of FIG. 3 is divided into three regions: linear elastic region 31, collapse region 32 (where plateau stress remains relatively constant) and densification region 33. In linear elastic region 31, the elastic portion of the stress-strain curve is only partially reversible. During loading, small-scale localized plastic deformation has already taken place within the sample. These small-scale plastic deformations also contribute to the mechanical damping of metal foams. In collapse region 32, the cell wall-buckling event occurs and the foam progressively collapses until densification region 33. The deformation in densification region 33 is highly localized and is preceded by the advance of a densification front from deformed to undeformed regions of the sample. For strain rate insensitive materials such as aluminum, the deformation behavior at the high strain rates remain the same. The area under the loading curve represents the deformation energy absorbed by the metal foam.

Metal foams can be fabricated to maximize the energy absorption capability by adjusting foam parameters including alloying elements, density level, cell size, wall thickness, and uniformity. Improvements in modulus and plateau stress via heat treatment of the metal foam, or via addition of particulate or whisker reinforcements to the metal foam, are additional techniques known to increase the energy absorption capability.

Figure 4:
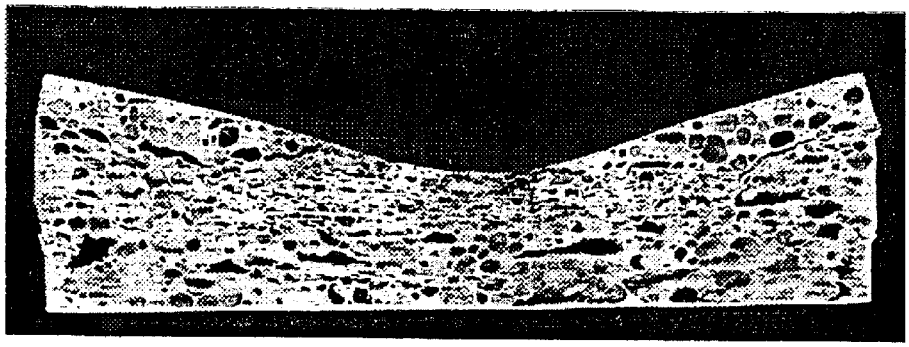
FIG. 4 is photomicrograph of the aluminum foam of FIG. 2 showing a cross-sectional view of the microstructure following deformation by high energy impact.

Metal foams are capable of mitigating the impact-induced stress waves from the strike plate, thereby delaying or eliminating damage to underlying layers, which in some embodiments might be a ceramic tile, and improving protection of the personnel and equipment behind the target. The deformation energy due to shock impact first densifies the front portion (in the loading direction) of the metal foam layer that forms the shock energy-absorbing element. Subsequent deformation introduces tearing and shearing of the cell walls, an effect of core shearing deformation for energy dissipation in the cellular structure. Thus, the deformation energy is redirected and dissipated sideways. This is best illustrated in FIG. 4 which is a cross-sectional view of the microstructure of the aluminum foam of FIG. 2 showing deformation following high energy impact. This type of deformation mechanism reduces the transmitted deformation energy behind the target in the loading direction. The energy of the impact-induced stress waves is also dissipated efficiently within the cellular network. The high degree of porosity in metal foam is beneficial for the absorption of the wave energy, and the cellular network generates the cavity effect for scattering the wave energy within the network.

The armor systems of the present invention would be useful as protection systems for ballistic impact and for blast. Moreover, while the illustrative embodiment presented herein is directed to a three element system, it is to be understood that invention contemplates the use of closed-cell, high strength metal foams having a high fraction of porosity, as a shock energy-absorbing element in any other configuration developed, or to be developed, wherein its ability to contain rearward deformation under high-speed impact, would be useful.

Although the invention has been described in terms of specific embodiments and applications, persons skilled in the art can, in light of this teaching, generate additional embodiments without exceeding the scope or departing from the spirit of the invention described herein. Accordingly, it is to be understood that the drawing and description in this disclosure are proffered to facilitate comprehension of the invention, and should not be construed to limit the scope thereof.

What is claimed is:

1. A multi-layered armor system comprising: a shock-absorbing element of a metallic foam having cells distributed therethrough, the cells being arranged to facilitate densification of the metallic foam;

a strike plate arranged on a first side of said shock-absorbing element; and a deformable backing plate arranged on a second side of said shock-absorbing element;

whereby the application of a force on said strike plate urges said shock-absorbing element to progressive modes of deformation corresponding to a substantially linear elastic deformation, a cellular collapse deformation, and a densification, in response to the magnitude of the force applied to said strike plate.

2. A multi-layered armor system of claim 1 wherein the strike plate is selected from the group consisting of high strength metals, ceramics, and polymer-based composites.

3. The multi-layered armor system of claim 1 wherein the shock energy-absorbing element comprises a closed-cell metalic foam.

4. The multi-layered armor system of claim 3 wherein the closed-cell metalic foam is selected from the group consisting of closed-cell metalic foams of aluminum, steel, lead, zinc, titanium, nickel and alloys or metal matrix composites thereof.

5. The multi-layered armor system of claim 4 where the closed-cell metallic foam has a porosity that ranges from about 50–98 percent by volume.

6. The multi-layered armor system of claim 1 wherein the deformable backing plate comprises a metal selected from the group consisting of titanium, aluminum, and steel.

7. The multi-layered armor system of claim 4 wherein the closed-cell metalic foam is a closed-cell metalic foam of aluminum.

8. The multi-layered armor system of claim 7 wherein the closed-cell metalic foam of aluminum has a porosity of 80 percent by volume.

* * * * *

UNITED STATES PATENT AND TRADEMARK OFFICE

CERTIFICATE OF CORRECTION

PATENT NO. : 6,698,331 B1 
DATED : March 2, 2004
INVENTOR(S) : Chin-Jye Yu, T. Dennis Claar and Harald H. Eifert It is certified that error appears in the above-identified patent and that said Letters Patent is hereby corrected as shown below:

Column 6,
Line 13, after "densification" insert -- deformation --.

Signed and Sealed this

Eighth Day of June, 2004

JON W. DUDAS
*Acting Director of the United States Patent and Trademark Office*